US011692554B2

(12) United States Patent
Botkin et al.

(10) Patent No.: US 11,692,554 B2
(45) **Date of Patent: *Jul. 4, 2023**

(54) CEILING FAN WITH MULTIPLE BLADES

(71) Applicant: HUNTER FAN COMPANY, Memphis, TN (US)

(72) Inventors: Charles William Botkin, Cordova, TN (US); Bobby Neal Norwood, Oakland, TN (US)

(73) Assignee: Hunter Fan Company, Memphis, TN (US)

( * ) Notice: Subject to any disclaimer, the term of this patent is extended or adjusted under 35 U.S.C. 154(b) by 155 days.

This patent is subject to a terminal disclaimer.

(21) Appl. No.: 17/394,846

(22) Filed: Aug. 5, 2021

(65) Prior Publication Data

US 2021/0364002 A1 Nov. 25, 2021

Related U.S. Application Data

(63) Continuation of application No. 16/732,984, filed on Jan. 2, 2020, now Pat. No. 11,118,592.

(51) Int. Cl.

| | |
|---|---|
| ***F04D 25/08*** | (2006.01) |
| ***F04D 29/34*** | (2006.01) |
| ***F04D 29/66*** | (2006.01) |

(52) U.S. Cl.

CPC ..... *F04D 25/088* (2013.01); *F04D 29/34* (2013.01); *F04D 29/662* (2013.01); *F04D 29/668* (2013.01); *F05D 2230/64* (2013.01); *F05D 2240/307* (2013.01); *F05D 2260/96* (2013.01)

(58) Field of Classification Search

None

See application file for complete search history.

(56) References Cited

U.S. PATENT DOCUMENTS

| | | | | |
|---|---|---|---|---|
| 2,317,502 | A | 4/1943 | Upson | |
| 3,103,977 | A * | 9/1963 | Negroni | B64C 27/46 416/241 A |
| 4,305,292 | A | 12/1981 | Felter | |
| 5,380,156 | A | 1/1995 | Iacovino | |
| 5,433,585 | A | 7/1995 | Yan | |
| 5,593,281 | A | 1/1997 | Tai | |
| 5,988,978 | A | 11/1999 | Pearce | |
| 7,370,529 | B2 | 5/2008 | Lenz | |
| 7,914,260 | B2 | 3/2011 | Pearce | |
| 8,206,110 | B2 | 6/2012 | Vettese | |
| 9,664,197 | B2 | 5/2017 | Walker et al. | |
| 9,726,192 | B2 | 8/2017 | Whitley et al. | |
| 11,118,592 | B2 * | 9/2021 | Botkin | F04D 25/088 |
| 2007/0009363 | A1 * | 1/2007 | King | F04D 25/088 416/210 R |
| 2007/0196212 | A1 | 8/2007 | Hort et al. | |
| 2016/0290357 | A1 * | 10/2016 | Whitley | F04D 19/002 |
| 2021/0207609 | A1 * | 7/2021 | Botkin | F04D 29/662 |

* cited by examiner

*Primary Examiner* — Juan G Flores
(74) *Attorney, Agent, or Firm* — McGarry Bair PC

(57) ABSTRACT

A ceiling fan assembly having a motor with a rotor with multiple blade mounts, multiple blades having a removable blade tip, a balancing weight mount carried by the multiple blades and covered by the removable tip, and where each of the multiple blades are pre-balanced and indexed to a corresponding one of the multiple blade mounts.

23 Claims, 4 Drawing Sheets

CEILING FAN WITH MULTIPLE BLADES

CROSS-REFERENCE TO RELATED APPLICATIONS

This application is a continuation application of U.S. patent application Ser. No. 16/732,984, filed Jan. 2, 2020, presently allowed, which is hereby incorporated herein by reference in its entirety.

BACKGROUND OF THE INVENTION

Typical ceiling fans are electrically powered, being electrically coupled to a building electrical supply. The ceiling fans include an electric motor that is suspended beneath a ceiling by a hollow downrod through which electrical wires extend from the building electrical supply to the motor. An annular array of fan blades are coupled to the motor such that the blades can rotate about the motor, pushing a flow of air.

A technical issue with ceiling fans is that an imbalance between the blades can contribute to the amount of wobble a fan exhibits during use. Consumers often perceive wobble as an indicator of the quality and safety of a ceiling fan. During installation, balancing the fan blades can be difficult and take a significant amount of time for an installer. The larger the blade span, the greater chance of imbalance due to the natural variance in materials. Further, higher rotational speeds also can contribute to the amount of wobble a fan will exhibit due to imbalances of the blades.

BRIEF DESCRIPTION OF THE INVENTION

In one aspect, the disclosure relates to a ceiling fan assembly comprising: a motor having a rotor; a set of blades coupled to the rotor, with each blade of the set of blades including a removable blade tip; and a balancing weight provided within at least one removable blade tip from the set of blades.

In another aspect, the disclosure relates to a ceiling fan kit comprising: a motor having a rotor with a set of blade mounts; a set of blades configured to mount to the motor at the set of blade mounts, with each blade including a removable blade tip; and a set of balancing weights configured to mount to the set of blades at the removable blade tip.

In another aspect, the disclosure relates to a method of balancing a ceiling fan comprising: mounting a balancing weight to a blade on the ceiling fan by securing the balancing weight to the blade within a removable blade tip.

DETAILED DESCRIPTION

Figure 1:
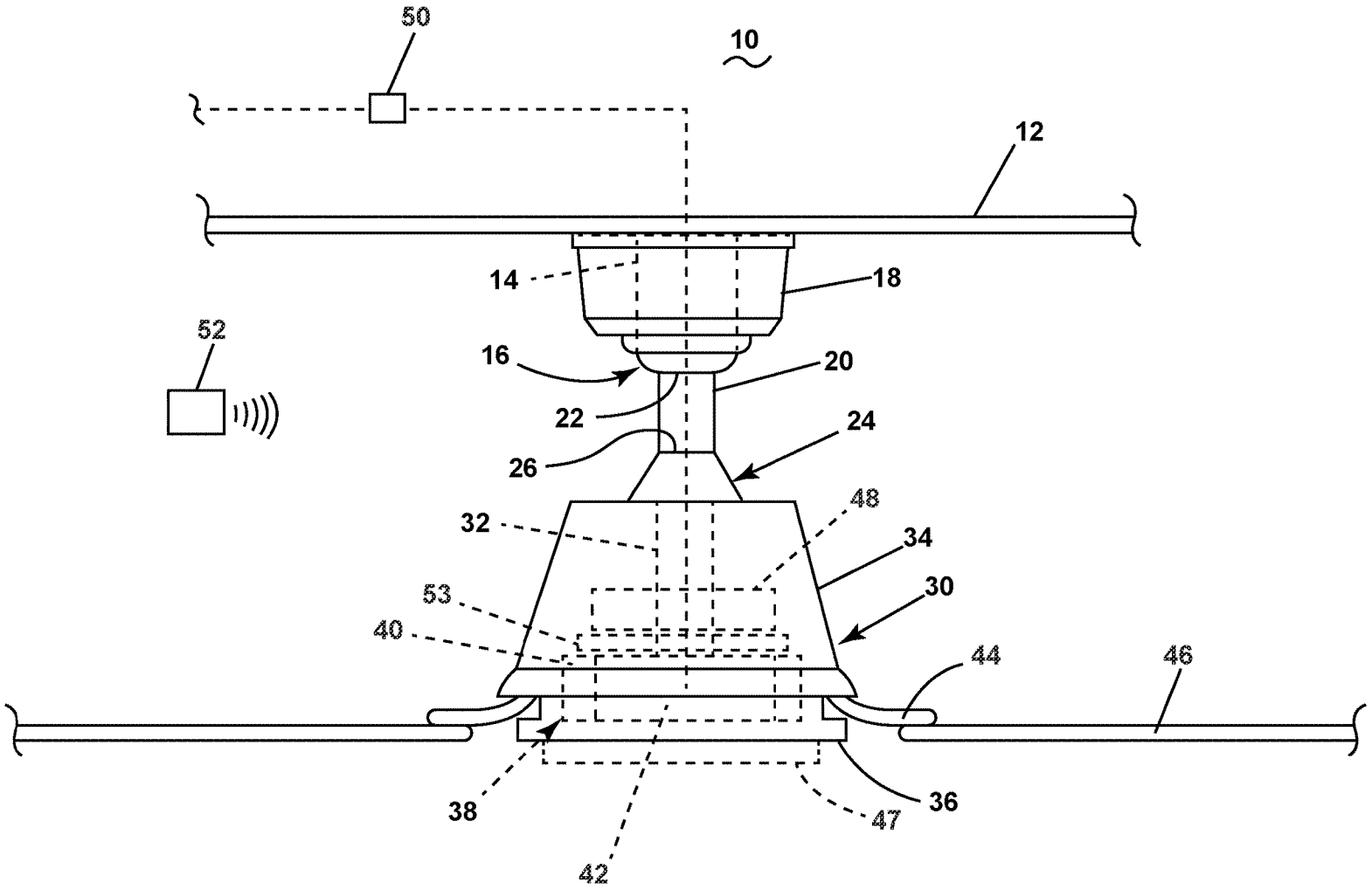
FIG. 1 illustrates a schematic side view of a ceiling fan mounted to a structure and including a blade mounting assembly according to an aspect of the disclosure.

The present disclosure is directed to a ceiling fan assembly having a blade balancing assembly carried by the fan blades for pre-balancing the fan and each of the blades during initial assembly in order to eliminate the need for visible balance weights on the outer surface of the blade post-installation. For purposes of illustration, the present disclosure will be described with respect to an exemplary ceiling fan motor housed in an exemplary ceiling fan housing. It will be understood, however, that the disclosure is not so limited and can have general applicability in all ceiling fan or mounting applications, such lighting or suspension for industrial, commercial, and residential applications, as well as a plurality of different ceiling fan designs. It can also have application to ceiling fans comprising multiple motors or angularly oriented motors. Furthermore, the blade balancing assembly as described herein will be compatible with all ceiling fan assemblies.

The disclosure is related to a ceiling fan assembly which can be used, for example, in residential and commercial applications. Such applications can be indoors, outdoors, or both. While this description is primarily directed toward a commercial ceiling fan, it is also applicable to any environment utilizing fans or for cooling areas utilizing air movement.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a ceiling fan 10 is suspended from a structure 12, such as a ceiling of a building. A structure mount 14 secures to the structure 12 and seats a ball mount assembly 16. A canopy 18 encloses the structure mount 14, providing an aesthetically pleasing junction between the ball mount assembly 16 and the structure 12. A downrod 20 couples to the ball mount assembly 16 at a first end 22. A motor adapter assembly 24 couples to the downrod 20 at a second end 26, opposite of the ball mount assembly 16. A motor housing 30 and a motor shaft 32 couple to the motor adapter assembly 24 opposite of the downrod 20. The motor housing 30 can be separated into an upper housing 34 and a lower housing 36, with the upper housing 34 coupling to the motor adapter assembly 24. The motor housing 30 encases a motor 38 having a rotor 40 and a stator 42, with the motor shaft 32 extending from the motor 38 to the motor adapter assembly 24.

A set of blade irons 44 can couple a set of complementary blades 46 to the motor 38. The motor 38 can be electrically powered to rotatably drive the blades 46 to push a volume of air. Optionally, a light kit 47 or switch housing can be provided on the motor housing 30, and is shown positioned at the bottom of the lower housing 36.

A controller 48 can be mounted above the motor 38, and encased in the upper housing 34, with a mounting plate 53 therebetween to support the controller 48. The controller 48 can be electrically coupled to an electrical supply 50 to control operation of the ceiling fan 10 and supply power to the motor 38. Alternatively, the controller 48 can be wirelessly or communicatively coupled to the ceiling fan 10, configured to control operation of the ceiling fan 10 remotely, without a dedicated connection. Non-limiting examples of controls for the ceiling fan 10 can include fan speed, fan direction, or light operation. Furthermore, a separate wireless controller 52, alone or in addition to the wired controller 48, can be communicatively coupled to a controller or a wireless receiver in the ceiling fan 10 to control operation of the ceiling fan 10. It is further contemplated in one alternative example that the ceiling fan be operated by the wireless controller 52 alone, and is not operably coupled with the wired controller 48.

Figure 2:
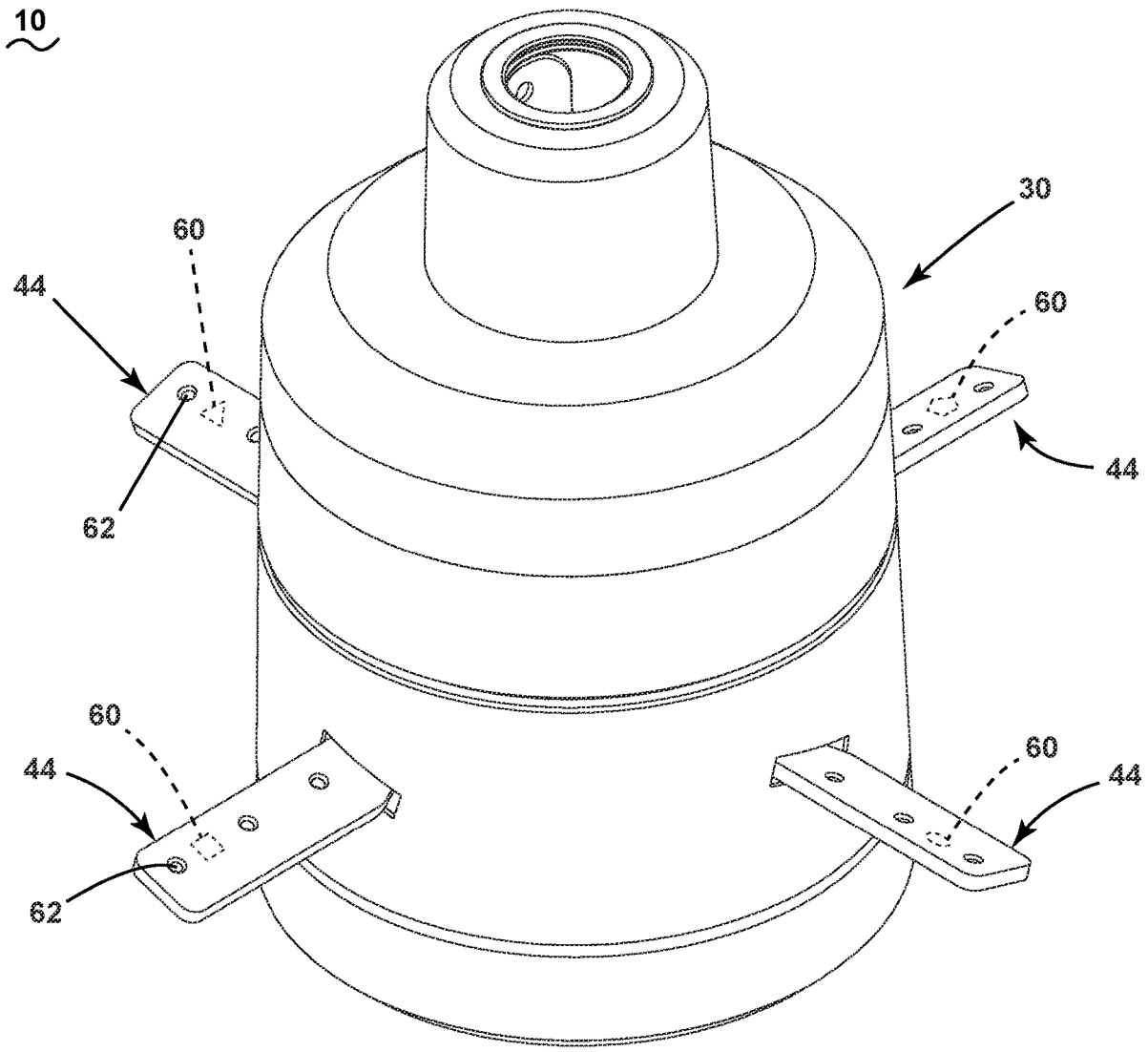
FIG. 2 is a perspective view of a portion of the ceiling fan of FIG. 1 illustrating a portion of the blade mounting assembly.

FIG. 2 illustrates the motor housing 30 of ceiling fan 10 with the set of blade irons 44 exposed. Each blade iron 44 includes a unique indicia 60 on the exterior of the blade iron 44. By way of non-limiting example, the unique indicia 60 can be color, shape, text, or any other indicia which can be unique to each blade mount 44 of the ceiling fan 10. For the purposes of illustration, each indicia 60 is illustrated as a different shape shown in broken line. Each blade iron 44 can further include one or more apertures 62 configured to receive a fastener.

Figure 3:
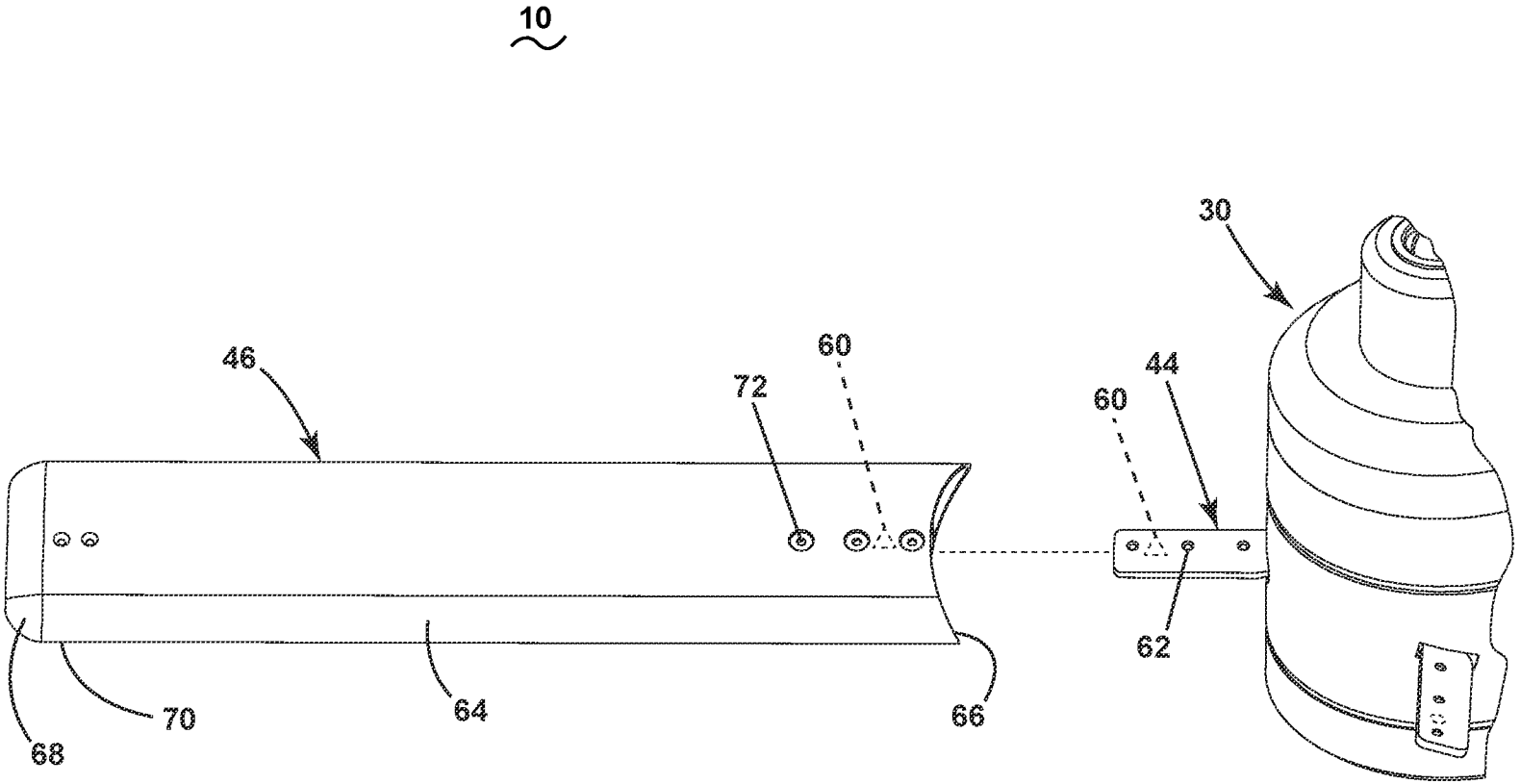
FIG. 3 a perspective view of a portion of the ceiling fan of FIG. 1 including a ceiling fan blade illustrating the blade mounting assembly.

Turning to FIG. 3, each blade 46 can have corresponding indicia 60 such that the indicia of each blade 46 of the ceiling fan 10 can be matched to the corresponding blade iron 44 onto which the blade 46 should be mounted. Each blade 46 can include blade body 64, which can be at least partially hollow, configured to receive the blade iron 44 at a proximal end 66, and a blade tip 68 at a distal end 70 of the blade 46 opposite the proximal end 66 and the blade iron 44. The blade 46 can further include one or more apertures 72 corresponding to apertures 62 and configured to receive a fastener in order to secure each blade 46 to each blade iron 44. By way of non-limiting example, fasteners can include bolts, screws, pins, or any other fastener capable of securing corresponding elements together.

Figure 4:
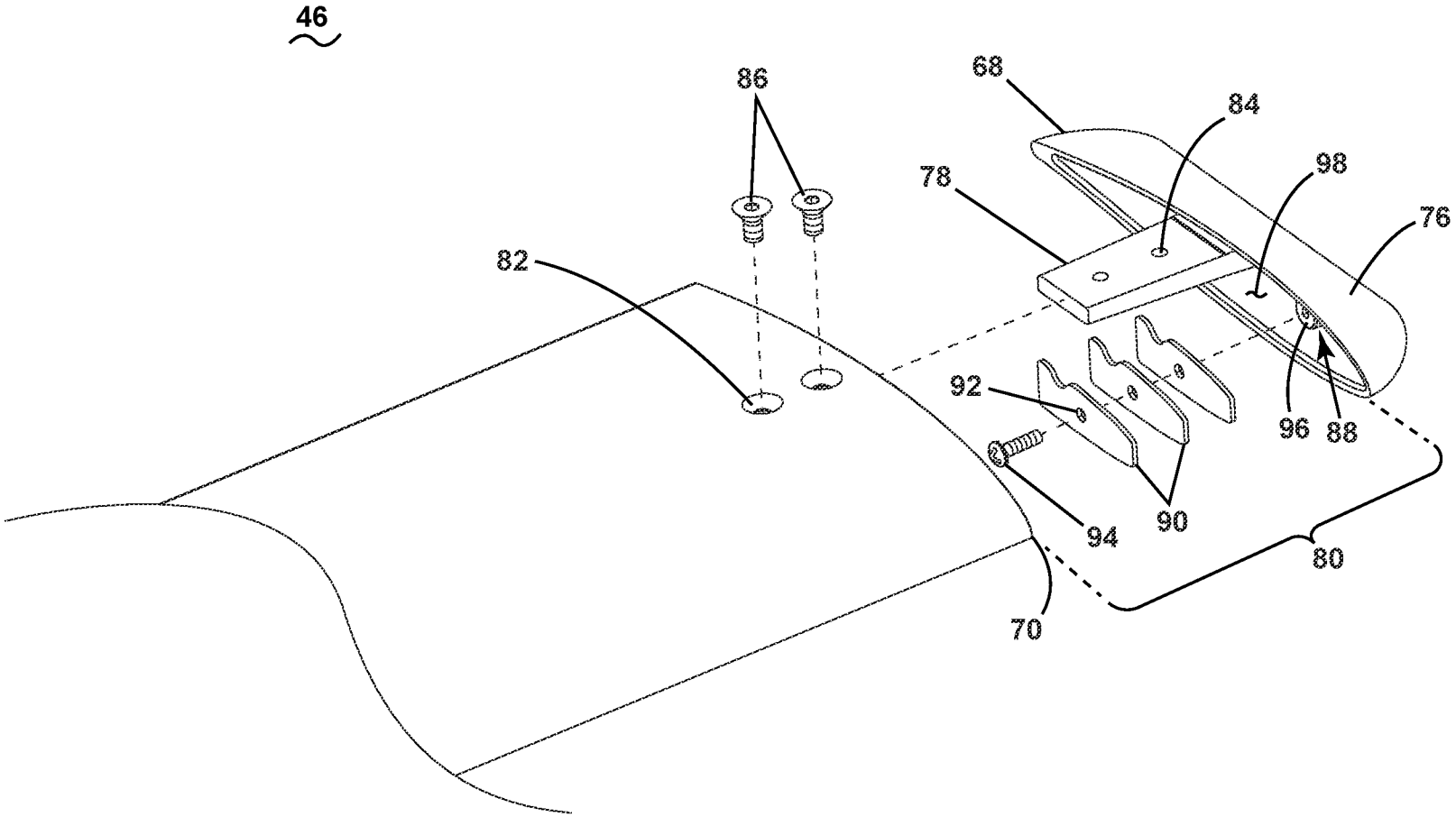
FIG. 4 is an exploded view of the ceiling fan blade of FIG. 3 including a blade balancing assembly.

FIG. 4 illustrates an exploded view of the distal end 70 of the blade 46. The blade tip 68 can include a cap 76 from which a stem 78 extends and a blade balancing assembly 80. The distal end 70 of the blade 46 can include one or more apertures 82. The stem 78 can include one or more apertures 84 corresponding to apertures 82. The stem 78 can be received in the distal end 70 of the blade body 64 and can be secured with one or more fasteners 86 through apertures 82 and 84. By way of non-limiting example, fasteners 86 can include bolts, screws, pins, or any other fastener capable of securing corresponding elements together.

The blade balancing assembly 80 can include a balancing weight mount 88 and one or more balancing weights 90. The balancing weight mount 88 can be carried by the blade tip 68, or alternatively, by the blade body 64. The balancing weights 90 can be of any shape suitable for mounting to the balancing weight mount 88 and can include one or more apertures 92 configured to receive a fastener 94. For example, the balancing weight mount 88 can be a mounting boss 96 provided on the blade tip 68 on an interior 98 of the cap 76. Each balancing weight 90 includes one aperture 92 and the fastener 94 removably secures the balancing weight 90 through the aperture 92 and into the mounting boss 96. By way of non-limiting example, fasteners 94 can include bolts, screws, pins, or any other fastener capable of securing corresponding elements together.

Alternatively, the balancing weights 90 can be integrally formed with the balancing weight mount 88, and configured to be removable such that the balancing weights 90 'break away', for example, as a tabbed feature, where weight can only be removed from the blade balancing assembly 80. Further, the blade balancing assembly 80 can alternatively be provided to the proximal end 66 of the blade 46, or to the blade iron 44.

During assembly of the ceiling fan 10 at a factory, electronic balance equipment can detect and identify the location and amount of imbalance on the ceiling fan 10. As imbalances are detected, mounting weights 90 can be added or removed from each mounting boss 96 until the blades 46 are balanced. Prior to disassembly for packaging, each blade iron 44 and blade 46 pair can be marked with the unique indicia 60 such that an installer can later match each balanced blade 46 with the corresponding blade iron 44 in order to maintain the balance of the ceiling fan 10. Alternatively, a trained installer could add or remove mounting weights 90 if needed during installation.

Weight variances in a ceiling fan can create wobble during operation. Consumers often perceive a ceiling fan that wobbles as low quality and unsafe. Often, when a consumer experiences wobble post-installation, a balance kit is sent to the consumer to add weight to the exterior of a blade body in order to combat wobble. For large commercial space fan designs, users and installers are often not equipped to balance these large ceiling fans. Therefore, pre-balancing the blades at the factory, prior to installation by utilizing a blade balancing assembly together with an identification system to match the pre-balanced blade to the correct blade iron location can help eliminate wobble and improve the ease of installation of the ceiling fan. Balanced blades provide a smoother, quieter, and more efficient ceiling fan, improving consumer satisfaction.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to explain the disclosure, including the best mode, and to enable any person skilled in the art to practice the disclosure, including making and using any devices or systems and performing any incorporated methods. The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceiling fan assembly comprising:

a motor having a rotor;

a set of blades coupled to the rotor, with each blade of the set of blades including a removable blade tip; and a balancing weight provided within at least one removable blade tip from the set of blades, wherein the balancing weight is carried by the at least one removable blade tip.

2. The ceiling fan assembly of claim 1 wherein the balancing weight is covered by the at least one removable blade tip.

3. The ceiling fan assembly of claim 1 further comprising a balancing weight mount provided within the- at least one removable blade tip.

4. The ceiling fan assembly of claim 3 wherein the balancing weight is mounted to the blade at the balancing weight mount.

5. The ceiling fan assembly of claim 4 wherein the balancing weight mount comprises a mounting boss.

6. The ceiling fan assembly of claim 5 wherein the mounting boss is located on the at least one removable blade tip.

7. The ceiling fan assembly of claim 6 wherein the mounting boss is located within an interior of the at least one removable blade tip.

8. The ceiling fan assembly of claim 1 wherein the at least one removable blade tip comprises a cap from which extends a stem, which is received within a corresponding blade of the set of blades to mount the at least one removable blade tip to its corresponding blade of the set of blades.

9. The ceiling fan assembly of claim 8 further comprising at least one fastener passing through the corresponding blade and into the stem.

10. The ceiling fan assembly of claim 1 wherein each blade of the set of blades includes an iron mounted to the corresponding blade.

11. A ceiling fan kit comprising:

a motor having a rotor with a set of blade mounts;

a set of blades configured to mount to the motor at the set of blade mounts, with each blade including a removable blade tip; and a set of balancing weights configured to mount to the set of blades at the removable blade tip wherein the set of balancing weights are pre-balanced to the set of blades and the set of balancing weights are arranged with indicia to indicate a corresponding ceiling fan blade.

12. A method of balancing a ceiling fan comprising:

mounting a balancing weight to a blade on the ceiling fan by securing the balancing weight to the blade within a removable blade tip; and attaching the balancing weight to a boss provided on the removable blade tip.

13. The method of claim 12 wherein the boss is provided within an interior of the removable blade tip.

14. The method of claim 12 further comprising securing the removable blade tip to the blade.

15. The method of claim 14 wherein securing the removable blade tip includes connecting a stem within the removable blade tip to the blade.

16. The method of claim 15 wherein the stem is secured to blade with a fastener.

17. A ceiling fan assembly comprising:

a motor having a rotor;

a set of blades coupled to the rotor, with each blade of the set of blades including a removable blade tip;

a balancing weight provided within at least one removable blade tip from the set of blades; and a balancing weight mount provided within the at least one removable blade tip.

18. The ceiling fan assembly of claim 17 wherein the balancing weight is mounted to the blade at the balancing weight mount.

19. The ceiling fan assembly of claim 18 wherein the balancing weight mount comprises a mounting boss.

20. The ceiling fan assembly of claim 19 wherein the mounting boss is located on the at least one removable blade tip.

21. The ceiling fan assembly of claim 20 wherein the mounting boss is located within an interior of the at least one removable blade tip.

22. A ceiling fan assembly comprising:

a motor having a rotor;

a set of blades coupled to the rotor, with each blade of the set of blades including a removable blade tip; and a balancing weight provided within at least one removable blade tip from the set of blades;

wherein the at least one removable blade tip comprises a cap from which extends a stem, which is received within a corresponding blade of the set of blades to mount the at least one removable blade tip to its corresponding blade of the set of blades.

23. The ceiling fan assembly of claim 22 further comprising at least one fastener passing through the corresponding blade and into the stem.

* * * * *